US005699678A

United States Patent [19]

Trigiani

[11] Patent Number: 5,699,678

[45] Date of Patent: Dec. 23, 1997

[54] CHARGING DEVICE

[76] Inventor: Phil Trigiani, 1786 Mattawa Avenue, Mississauga, Ontario, Canada, L4X 1K1

[21] Appl. No.: 634,025

[22] Filed: Apr. 17, 1996

[51] Int. Cl.[6] ..... F25B 45/00

[52] U.S. Cl. ..... 62/292; 62/389; 62/468; 222/391; 222/380

[58] Field of Search ..... 62/292, 389, 468, 62/77, 84; 222/386, 391, 392, 389, 380

[56] References Cited

U.S. PATENT DOCUMENTS

| | | | |
|---|---|---|---|
| 940,572 | 11/1909 | Agner | 222/391 |
| 972,793 | 10/1910 | Allred | 222/391 |
| 2,102,591 | 12/1937 | Hagemeier | 222/386 |
| 2,236,727 | 4/1941 | Dewees | 222/386 |
| 4,467,620 | 8/1984 | Bradley et al. | 62/292 |
| 4,913,323 | 4/1990 | Scheindel | 222/386 |
| 5,421,159 | 6/1995 | Stokes | 62/389 |

FOREIGN PATENT DOCUMENTS

| | | | |
|---|---|---|---|
| 11155 | 8/1887 | United Kingdom | 222/391 |

*Primary Examiner*—John M. Sollecito
*Attorney, Agent, or Firm*—Michael I. Kroll

[57] ABSTRACT

An improved charging device (20) comprising a vessel (22) for holding a liquid (24) therein. A component (26) on the vessel (22) is for allowing the liquid (24) to exit therefrom. A facility (28) on the vessel (22) is for dispensing the liquid (24) in controlled amounts through the exit component (26).

8 Claims, 2 Drawing Sheets

CHARGING DEVICE

BACKGROUND OF THE INVENTION

1. Field of the Invention

The instant invention relates generally to injector infusers and more specifically it relates to an improved charging device for air conditioning and refrigeration systems.

2. Description of the Prior Art

Numerous injector infusers have been provided in prior art, that are adapted to utilize a refrigerant as a means by which to propel lubricants into air conditioning and refrigeration systems. While these units may be suitable for the particular purpose to which they address, they would not be as suitable for the purposes of the present invention as heretofore described.

SUMMARY OF THE INVENTION

A primary object of the present invention is to provide an improved charging device that will overcome the shortcomings of the prior art devices.

Another object is to provide an improved charging device that will eliminate the need to use a refrigerant when a lubricant is infused into air conditioning and refrigeration systems.

An additional object is to provide a an improved charging device in which the infusion process when expedited is safer since there is no new refrigerant added, therefore any refrigerant loss through leakage is minimized.

A further object is to provide an improved charging device that is simple and easy to use.

A still further object is to provide an improved charging device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
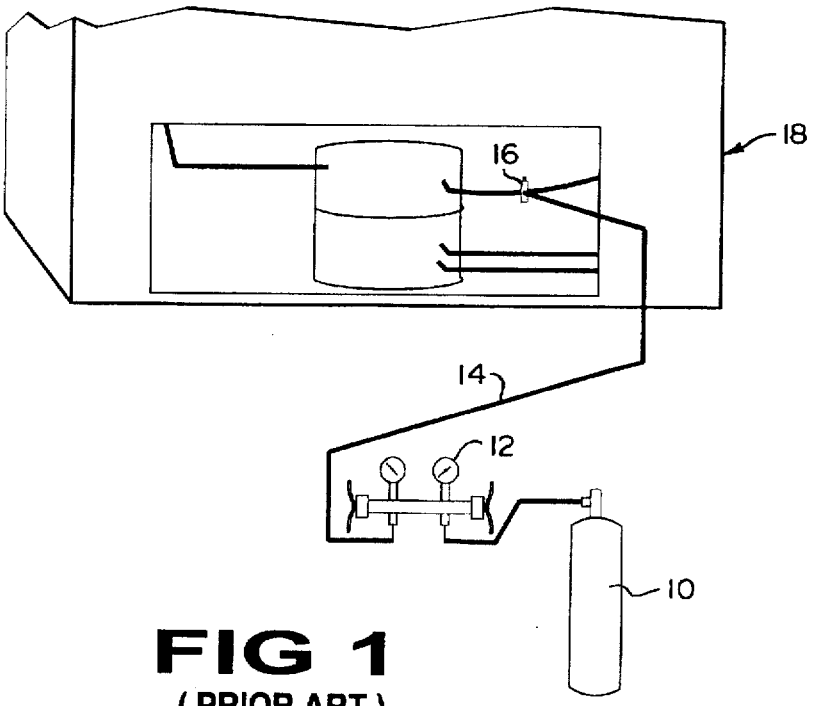
FIG 1 ( PRIOR ART )
FIG. 1 is a perspective view of the prior art, showing a pressurized tank with a refrigerant to propel lubricants into an air conditioning/refrigeration system.

Turning now descriptively to the drawings, in which similar reference characters denote similar elements throughout the several views, FIG. 1 illustrates the prior art. A pressurized tank 10 with refrigerant and/or oil inside connected to gauges 12 is fluidly coupled via a line 14 to a service fitting 16 of an air conditioning/refrigeration system 18.

Figure 2:
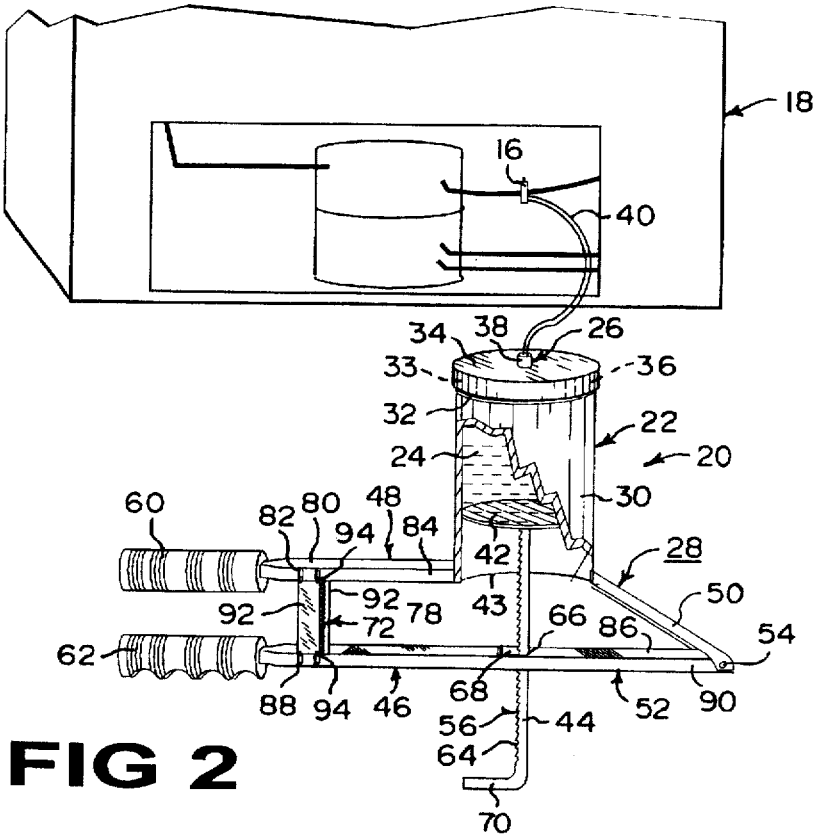
FIG. 2 is a perspective view of the instant invention, showing a liquid infused into the air conditioning/refrigeration system.
Figure 3:
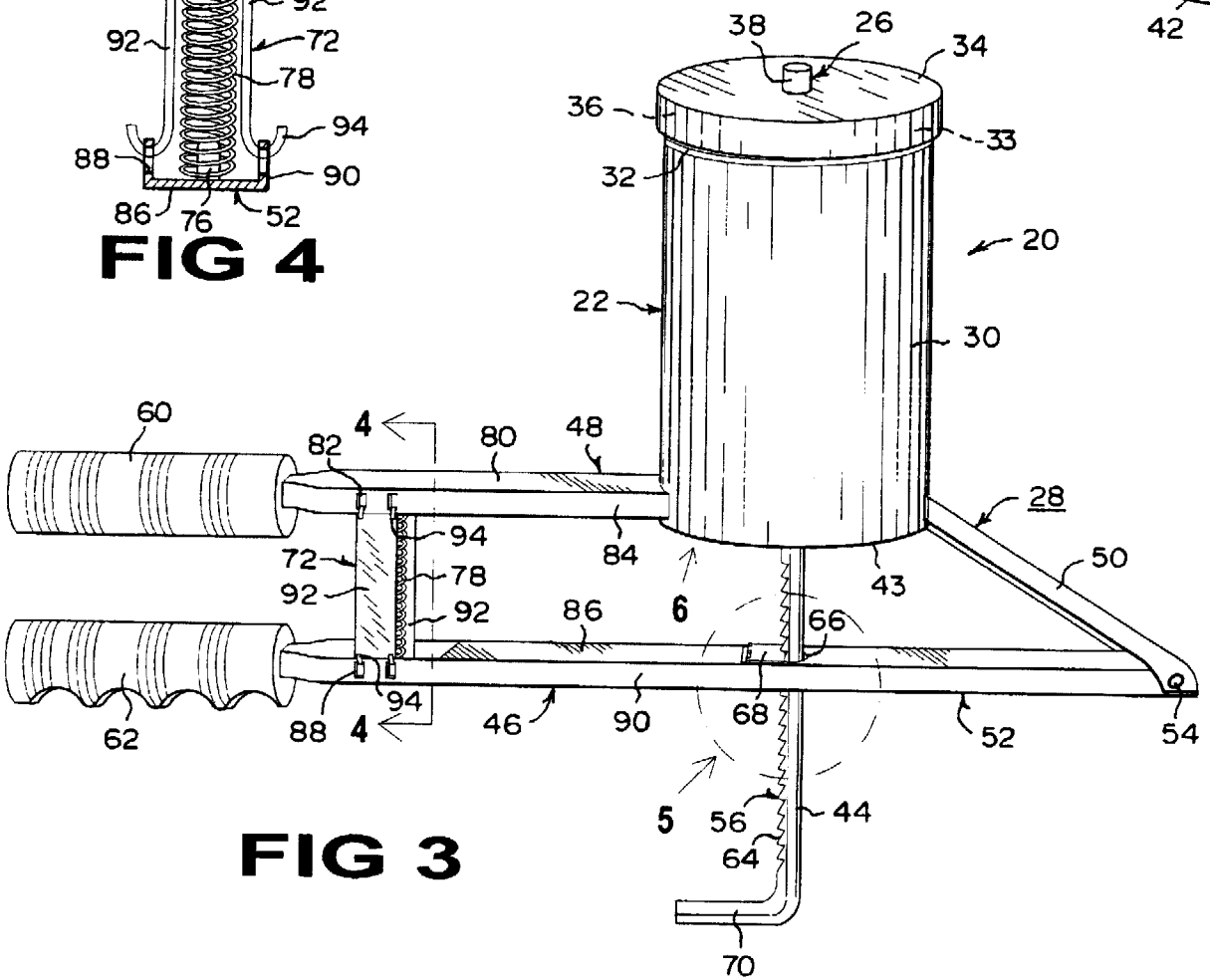
FIG. 3 is an enlarged perspective view of the instant invention per se.

The instant invention shown in FIGS. 2 and 3, is an improved charging device 20 comprising a vessel 22 for holding a liquid 24 therein. A component 26 on the vessel 22 is for allowing the liquid 24 to exit therefrom. A facility 28 on the vessel 22 is for dispensing the liquid 24 in controlled amounts through the exit component 26.

The vessel 22 includes a cylindrical housing 30 opened at both ends. External threads 32 can be formed on the first open end 33 of the cylindrical housing 30. An optional cap 34 having internal threads 36 can thread onto the external threads 32 on the cylindrical housing 30. The liquid exit component 26 is a connector 38 centrally formed on the cap 34. The connector 38 can typically engage with an end of an elongated tube 40 that can fluidly connect with the service fitting 16 of the air conditioning/refrigeration system 18.

The dispensing facility 28 consists of a disc shaped push plate 42 which snugly fits into the second open end 43 of the cylindrical housing 30 in a sliding manner. A push rod 44 is on the push plate. The push rod 44 extends outwardly from the second open end 43 of the cylindrical housing 30. An assembly 46 is for driving the push rod 44 into the cylindrical housing 30 with elevated levels of thrust, so that the push plate 42 will force the liquid 24 out of the liquid exit component 26.

The driving assembly 46 includes a fixed arm 48 that extends horizontally from a first lower side of the cylindrical housing 30. A pivot arm 50 extends at an angle downwardly from a second lower side of the cylindrical housing 30 opposite from the fixed arm 48. An actuating arm 52 is provided. A fulcrum pin 54 connects a free end of the pivot arm 50 to one end of the actuating arm 52, so that the actuating arm 52 extends below the fixed arm 48. A ratchet mechanism 56 on the push rod 44 is operable by the actuating arm 52, when the actuating arm 52 is manually pivoted towards the fixed arm 48. The push rod 44 will move up into the second open end 43 of the cylindrical housing 30.

Figure 6:
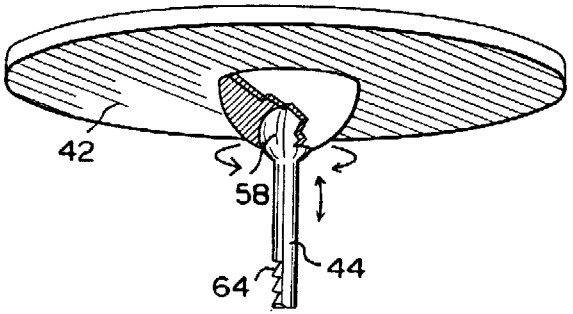
FIG. 6 is a further enlarged perspective view taken in the direction of arrow 6 in FIG. 3 with parts broken away, showing the universal joint between the push rod and push plate.

A universal joint 58, as shown in FIG. 6, is between a bottom surface of the push plate 42 and a top end of the push rod 44. The push rod 44 will always maintain a perpendicular position with respect to the actuating arm 52. A stationary hand grip 60 is on a free end of the fixed arm 48. A movable hand grip 62 is on a free end of the actuating arm 52. A person can grasp the stationary hand grip 60 and the movable hand grip 62 with one hand and squeeze together, so as to operate the ratchet mechanism 56.

Figure 5:
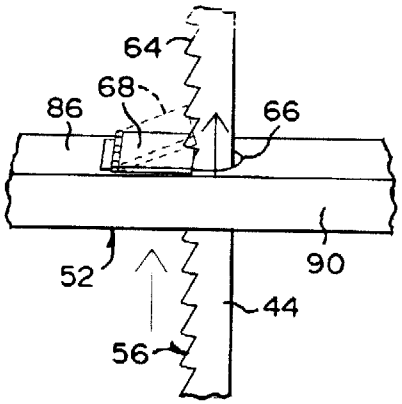
FIG. 5 is an enlarged perspective view of the area indicated by arrow 5 in FIG. 3, showing the ratchet mechanism in greater detail.

The ratchet mechanism 56, as best seen in FIG. 5, consists of a plurality of sloping ratchet teeth 64 extending along one side of the push rod 44. The actuating arm 52 has a transverse aperture 66 therethrough, so that the push rod 44 can extend through the aperture 66. A hinged catch 68 on the actuating arm 52 is to engage with the sloping ratchet teeth 64, to move the push rod 44 up into the second open end 43 of the cylindrical housing 30. A right angle handle 70 is formed on a free end of the push rod 44 to manually manipulate the push rod 44, to release the hinged catch 68 from the sloping ratchet teeth 64.

Figure 4:
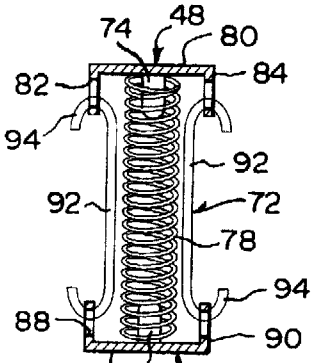
FIG. 4 is a cross sectional view taken along line 4—4 in FIG. 3, showing the movement limiting assembly in greater detail.

The driving assembly 46 further includes an assemblage 72 for limiting movement of the actuating arm 52 towards the fixed arm 48, to slowly operate the ratchet mechanism 56. The limiting movement assembly 72, as best seen in FIG. 4, includes a first retainer pin 74 extending downwardly from the fixed arm 48. A second retainer pin 76 extends upwardly from the actuating arm 52 directly below the first retainer pin 74. A spring 78 extends between the first retainer pin 74 and the second retainer pin 76 to normally bias the actuating arm 52 away from the fixed arm 48.

The fixed arm 48 is an inverted U-shaped channel 80 having a pair of spaced apart vertical slots 82 in each side wall 84 of the U-shaped channel 80 adjacent the first retainer pin 74. The actuating arm 52 is a U-shaped channel 86 having a pair of spaced apart vertical slots 88 in each side wall 90 of the U-shaped channel 86 adjacent the second retainer pin 76. A pair of rectangular plates 92 are provided. Each plate 92 has a pair of hooks 94 on each short end. The hooks 94 on a first short end of each plate 92 can engage with the slots 82 in each side wall 84 of the fixed arm 48. The hooks 94 on a second short end of each plate 92 can engage with the slots 88 in each side wall 90 of the actuating arm 52 to limit the movement of the actuating arm 52.

The liquid 24, as shown in FIG. 2, can be an oil lubricant, a fluorescent additive or other liquid substances. A refrigerant is not used in the device 20. The liquid 24 can be added by the device 20 to sealed, pressurized or discharged automotive, industrial, commercial and domestic air conditioning or refrigeration systems. Other dispensing facilities, not shown in the drawings, can be used to activate the push rod 44, such as an air operated or hydraulic ram, a compressed gas unit, an electric motor or by other means.

The cylindrical housing 30 can be substituted with a pre-filled disposable sealed cylindrical cartridge that holds the lubricant/additive. The pre-filled disposable sealed cylindrical cartridge is threaded or attached in some manner to the rest of the device 20 and will operate identically as the cylindrical housing 30.

LIST OF REFERENCE NUMBERS

10 pressurized tank (prior)
12 gauges to 10
14 line between 12 and 16
16 service fitting of 18
18 air conditioning/refrigeration system
20 improved charging device
22 vessel of 20
24 liquid in 22
26 liquid exit component of 20
28 dispensing facility of 20
30 cylindrical housing of 22
32 external threads on 30
33 first open end of 30
34 optional cap of 22
36 internal threads on 34
38 connector for 26
40 elongated tube between 38 and 16
42 disc shaped push plate of 28
43 second open end of 30
44 push rod on 42
46 driving assembly of 28
48 fixed arm of 46 on 30
50 pivot arm of 46 on 30
52 actuating arm of 46
54 fulcrum pin of 46
56 ratchet mechanism of 46
58 universal joint between 42 and 44
60 stationary hand grip on 48
62 movable hand grip on 52
64 sloping ratchet teeth of 56
66 transverse aperture in 52
68 hinged catch of 56
70 right angle handle on 44
72 limiting movement assemblage of 46
74 first retainer pin of 72 on 48
76 second retainer pin of 72 on 52
78 spring of 72 between 74 and 76
80 inverted U-shaped channel for 48
82 vertical slot in 84
84 side wall of 80
86 U-shaped channel for 52
88 vertical slot in 90
90 side wall of 86
92 rectangular plate of 72
94 hook on 92

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved charging device comprising:

A) a vessel for holding a liquid therein, said vessel including a cylindrical housing opened at both ends, with external threads formed on a first open end of said cylindrical housing and a cap having internal threads which can thread onto said external threads on said cylindrical housing;

B) means on said vessel for allowing the liquid to exit therefrom; and

C) means on said vessel for dispensing the liquid in controlled amounts through said exit means, said dispensing means including:

1) a disc shaped push plate which snugly fits into a second open end of said cylindrical housing in a sliding manner;

2) a push rod on said push plate, whereby said push rod extends outwardly from the second oven end of said cylindrical housing; and 3) means for driving said push rod into said cylindrical housing with elevated levels of thrust, so that said push plate will force the liquid out of said liquid exit means, said driving means including:

a) a fixed arm extending horizontally from a first lower side of said cylindrical housing;

b) a pivot arm extending at an angle downwardly from a second lower side of said cylindrical housing opposite from said fixed arm;

c) an actuating arm;

d) a fulcrum pin connecting a free end of said pivot arm to one end of said actuating arm, so that said actuating arm extends below said fixed arm;

e) a ratchet mechanism on said push rod operable by said actuating arm when said actuating arm is manually pivoted towards said fixed arm, so that said push rod will move up into the second open end of said cylindrical housing; and f) means for limiting movement of said actuating arm towards said fixed arm to slowly operate said ratchet mechanism, said movement limiting means including:

i) a first retainer pin extending downwardly from said fixed arm;

ii) a second retainer pin extending upwardly from said actuating arm directly below said first retainer pin;

iii) a spring extending between said first retainer pin and said second retainer pin to normally bias said actuating arm away from said fixed arm;

iv) said fixed arm being an inverted U-shaved channel having a pair of spaced apart vertical slots in each side wall of said U-shaped channel adjacent said first retainer pin;

v) said actuating arm being a U-shaped channel having a pair of spaced apart vertical slots in each side wall of said U-shaped channel adjacent said second retainer pin and vi) a pair of rectangular plates, each said plate having a pair of hooks on each short end, so that said hooks on a first short end of each said plate can engage with said slots in each said side wall of said fixed arm, while said hooks on a second short end of each said plate can engage with said slots in each said side wall of said actuating arm to limit the movement of said actuating arm.

2. An improved charging device as recited in claim 1, wherein said liquid exit means includes a connector centrally formed on said cap, whereby said connector can engage with an end of an elongated tube that can fluidly connect with a service fitting of an air conditioning/refrigeration system.

3. An improved charging device as recited in claim 1, wherein said driving means further includes a universal joint between a bottom surface of said push plate and a top end of said push rod, so that said push rod will always maintain a perpendicular position with respect to said actuating arm.

4. An improved charging device as recited in claim 1, wherein said driving means further includes:

a) a stationary hand grip on a free end of said fixed arm; and b) a movable hand grip on a free end of said actuating arm, so that a person can grasp said stationary hand grip and said movable hand grip with one hand and squeeze together, so as to operate said ratchet mechanism.

5. An improved charging device as recited in claim 1, wherein said ratchet mechanism includes:

a) a plurality of sloping ratchet teeth extending along one side of said push rod;

b) said actuating arm having a transverse aperture therethrough, so that said push rod can extend through said aperture;

c) a hinged catch on said actuating arm to engage with said sloping ratchet teeth to move said push rod up into the second open end of said cylindrical housing; and d) a right angle handle formed on a free end of said push rod to manually manipulate said push rod to release said hinged catch from said sloping ratchet teeth.

6. An improved charging device as recited in claim 2, wherein said driving means further includes a universal joint between a bottom surface of said push plate and a top end of said push rod, so that said push rod will always maintain a perpendicular position with respect to said actuating arm.

7. An improved charging device as recited in claim 6, wherein said driving means further includes:

a) a stationary hand grip on a free end of said fixed arm; and b) a movable hand grip on a free end of said actuating arm, so that a person can grasp said stationary hand grip and said movable hand grip with one hand and squeeze together, so as to operate said ratchet mechanism.

8. An improved charging device as recited in claim 7, wherein said ratchet mechanism includes:

a) a plurality of sloping ratchet teeth extending along one side of said push rod;

b) said actuating arm having a transverse aperture therethrough, so that said push rod can extend through said aperture;

c) a hinged catch on said actuating arm to engage with said sloping ratchet teeth to move said push rod up into the second open end of said cylindrical housing; and d) a right angle handle formed on a free end of said push rod to manually manipulate said push rod to release said hinged catch from said sloping ratchet teeth.

* * * * *